US009623463B2

(12) United States Patent
Yukita et al.

(10) Patent No.: US 9,623,463 B2
(45) Date of Patent: Apr. 18, 2017

(54) HYDRAULIC PRESS BRAKE

(71) Applicant: AMADA COMPANY, LIMITED, Kanagawa (JP)

(72) Inventors: Tomohiro Yukita, Kanagawa (JP); Akira Nakamura, Kanagawa (JP); Takanori Okubo, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 0 days.

(21) Appl. No.: 14/434,540

(22) PCT Filed: Oct. 4, 2013

(86) PCT No.: PCT/JP2013/077100
§ 371 (c)(1),
(2) Date: Apr. 9, 2015

(87) PCT Pub. No.: WO2014/061472
PCT Pub. Date: Apr. 24, 2014

(65) Prior Publication Data

US 2015/0273554 A1 Oct. 1, 2015

(30) Foreign Application Priority Data

Oct. 17, 2012 (JP) ..... 2012-229758

(51) Int. Cl.
*B21D 5/02* (2006.01)
*B30B 15/22* (2006.01)
(Continued)

(52) U.S. Cl.
CPC ..... *B21D 5/02* (2013.01); *B30B 1/32* (2013.01); *B30B 15/16* (2013.01); *B30B 15/161* (2013.01);
(Continued)

(58) Field of Classification Search
CPC ..... B21D 5/02; B21D 5/0245; B30B 15/16; B30B 15/161
See application file for complete search history.

(56) References Cited

U.S. PATENT DOCUMENTS 5,433,097 A 7/1995 Nord
5,644,915 A 7/1997 Dressing et al.

FOREIGN PATENT DOCUMENTS

CN 1402656 3/2003
CN 1971042 5/2007
(Continued)

OTHER PUBLICATIONS

Office Action issued in China Counterpart Patent Appl. No. 201380054048.4, dated Oct. 21, 2015 , along with an English translation thereof.
(Continued)

*Primary Examiner* — Debra Sullivan
(74) *Attorney, Agent, or Firm* — Greenblum & Bernstein, P.L.C.

(57) ABSTRACT

The pump discharge volume of a bi-directional piston pump is set to a reference pump discharge volume Qa in condition where the actuation state of lift cylinders is a no-load state, and is set to a small-discharge pump discharge volume Qb smaller than the reference pump discharge volume Qa in condition where the actuation state of the lift cylinders is a high-load state. Qb·Pb which is the product of the pump discharge volume Qb and a pump discharge pressure Pb of the bi-directional piston pump in condition where the actuation state of the lift cylinders is the high-load state is set to be equal to or less than or approximately equal to a Qa·Pa which is the product of the pump discharge volume Qa and a pump discharge pressure Pa of the bi-directional piston
(Continued)

pump in condition where the actuation state of the lift cylinders is the no-load state.

5 Claims, 8 Drawing Sheets

(51) Int. Cl.
*B30B 15/16* (2006.01)
*B30B 1/32* (2006.01)

(52) U.S. Cl.
CPC ..... *B30B 15/22* (2013.01); *F15B 2211/20553* (2013.01); *F15B 2211/20561* (2013.01); *F15B 2211/27* (2013.01); *F15B 2211/6336* (2013.01); *F15B 2211/6652* (2013.01); *F15B 2211/6654* (2013.01); *F15B 2211/7053* (2013.01); *F15B 2211/775* (2013.01)

(56) References Cited

FOREIGN PATENT DOCUMENTS

| | | |
|---|---|---|
| JP | 7-266086 | 10/1995 |
| JP | 7-275946 | 10/1995 |
| JP | 2000-107814 | 4/2000 |
| JP | 2001-121299 | 5/2001 |
| JP | 2001-124006 | 5/2001 |
| JP | 2001-263254 | 9/2001 |
| JP | 2002-239636 | 8/2002 |
| JP | 2004-301189 | 10/2004 |
| JP | 2004-358518 | 12/2004 |

OTHER PUBLICATIONS

Search report from Japan, mail date is Dec. 24, 2013.
Search Report issued in European Patent Office (EPO) Patent Application No. 13847216.2, dated Aug. 16, 2016.

HYDRAULIC PRESS BRAKE

TECHNICAL FIELD

The present invention relates to a hydraulic press brake configured to bend a plate-shaped workpiece clamped with a punch and a die.

BACKGROUND ART

In recent years, hydraulic press brakes have been developed in various ways. The configuration of a conventional, general hydraulic press brake may be briefly described as follows.

A general hydraulic press brake includes a body frame, and a lower table on which a die is detachably held is provided to a lower part of this body frame. Moreover, an upper table on which a punch is detachably held is provided to an upper part of the body frame in such a way as to face the lower table in the vertical direction and to be capable of being raised and lowered (movable in the vertical direction).

A lift cylinder configured to raise and lower the upper table is provided on each of both sides, in the longitudinal direction, of the tables (the lower table and the upper table) on the body frame. Moreover, each lift cylinder includes a tubular cylinder body and a piston provided inside the cylinder body in such a way as to be capable of being raised and lowered. The inside of the cylinder body is divided vertically into an upper hydraulic chamber and a lower hydraulic chamber by the piston.

A piston pump configured to supply pressure oil to the upper hydraulic chamber and the lower hydraulic chamber of each lift cylinder is provided at an appropriate position on the body frame. Moreover, the piston pump includes a pump rotary shaft, a rotary motor configured to rotate this pump rotary shaft, and an inclined plate inclined with respect to the pump rotary shaft. The inclination angle of the inclined plate with respect to the pump rotary shaft is constant (unchanged), and the pump discharge volume is set based on this inclination angle.

Here, the speed of raising and lowering of the upper table is set to a high speed in the case where the actuation state of the lift cylinders is a no-load state, and is set to a low speed in the case where the actuation state of the lift cylinders is a high-load state.

As this type of technique, those described in literatures listed below have heretofore been known, for example (Patent Literatures Japanese Patent Application Publication Nos. Hei 7-266086 and Hei 7-275946).

SUMMARY OF INVENTION

Technical Problem

Meanwhile, in recent years, the demand for energy saving has become stronger and stronger in the industrial world in view of protecting the global environment. Due to such a demand, in the field of press working such as bending, too, there is an urgent need to achieve energy saving through reduction of power consumption of electric equipment such as the rotary motor of a piston pump.

The present invention has been made in view of the above, and an object thereof is to provide a hydraulic press brake having a novel configuration which is capable of achieving energy saving through reduction of power consumption of the rotary motor of a piston pump.

In order to solve above mentioned problem, a hydraulic press brake configured to bend a plate-shaped workpiece by clamping the workpiece with a punch and a die, comprising:

a lower table which is provided to a lower part of a body frame and on which the die is detachably held;

an upper table which is provided to an upper part of the body frame in such a way as face the lower table in a vertical direction and is capable of being raised and lowered relative to the lower table, and on which the punch is detachably held;

a lift cylinder including a tubular cylinder body and a piston provided inside the cylinder body in such a way as to divide an inside of the cylinder body into a pair of hydraulic chambers and to be capable of being raised and lowered relative to the cylinder body, the lift cylinder including the cylinder body and the piston to raise and lower the upper table relative to the lower table; and a piston pump including a pump rotary shaft, a rotary motor configured to rotate the pump rotary shaft, and an inclined plate being pivotally movable relative to the pump rotary shaft and configured to vary a pump discharge volume of the piston pump through the pivotal movement, the piston pump being configured to supply pressure oil to the hydraulic chambers of the lift cylinder, wherein the pump discharge volume of the piston pump is set to a reference pump discharge volume in a case where an actuation state of the lift cylinder is a no-load state, and is set to a small-discharge pump discharge volume smaller than the reference pump discharge volume to lower a torque of the rotary motor of the piston pump in a case where the actuation state of the lift cylinder is a high-load state.

Note that in the description and the claims of the present application, a "rotary motor" is meant to include a control motor such as a servomotor or an inverter motor configured to rotate the above-mentioned pump rotary shaft in a forward direction and a reverse direction. Further, when "an/the actuation state of a/the lift cylinder(s) is a no-load state" is meant to include when the lift cylinder(s) is(are) in a light-load state, and when "an/the actuation state of the lift cylinder(s) is a high-load state" refers to when the lift cylinder(s) is(are) in a pressurizing state.

According to the present invention, the pump rotary shaft is rotated by driving the rotary motor of the piston pump with the workpiece set at a predetermined position on the die, to thereby supply the pressure oil to one of the hydraulic chambers of the lift cylinder and eject the pressure oil from the other hydraulic chamber of the lift cylinder. In this way, the upper table can be lowered relative to the lower table and the workpiece can be bent by cooperation of the punch and the die.

After the workpiece is bent, the piston pump is run to supply the pressure oil to the other hydraulic chamber of the lift cylinder and eject the pressure oil from the one hydraulic chamber of the lift cylinder. In this way, the upper table can be raised relative to the lower table and positioned to the above-mentioned predetermined relative height position (the normal operation of the hydraulic press brake described above).

Besides the normal operation of the hydraulic press brake described above, the pump discharge volume of the piston pump is made variable through the pivotal movement of the inclined plate of the piston pump; the pump discharge volume of the piston pump is set to the small-discharge pump discharge volume smaller than the reference pump discharge volume in the case where the actuation state of the lift cylinder is a high-load state. In this way, it is possible to lower the torque of the rotary motor of the piston pump in the case where the actuation state of the lift cylinder is a high-load state.

DESCRIPTION OF EMBODIMENTS

Hereinbelow, embodiments carrying out the present invention will be described by using the drawings.

Figure 1A:
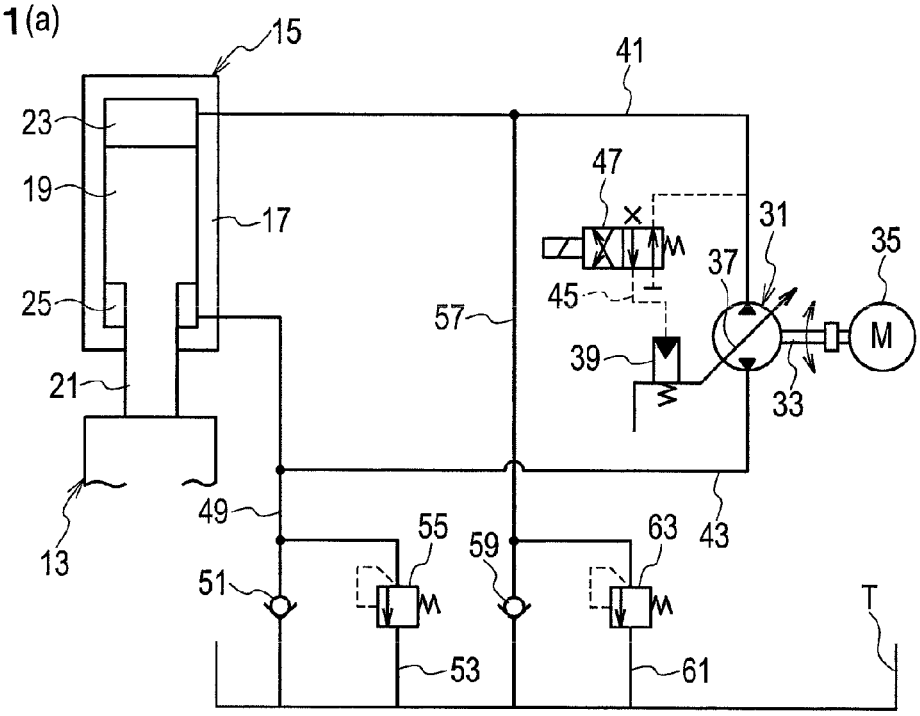
FIG. 1(*a*) is a diagram showing a hydraulic system according an embodiment of the present invention, and FIG. 1(*b*) is a diagram describing the operation of the hydraulic system according to the embodiment of the present invention.
Figure 1B:
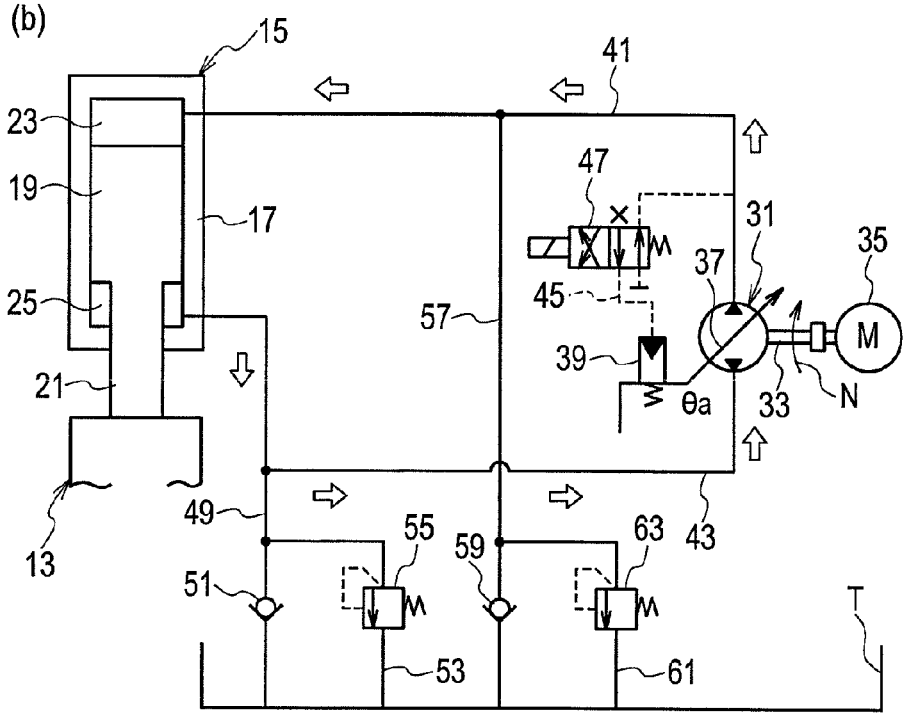
Figure 2A:
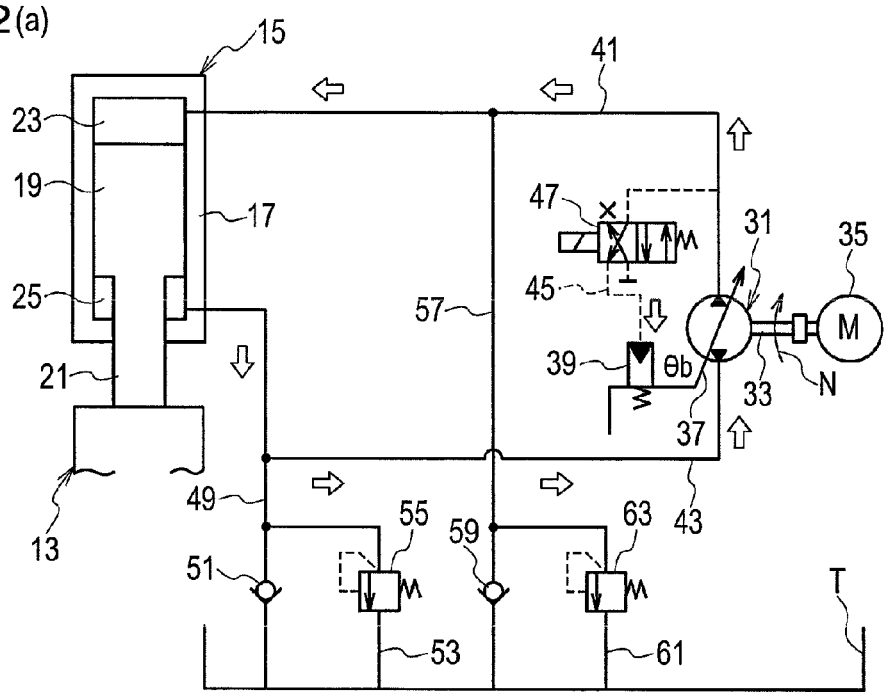
FIG. 2(*a*) is a diagram describing the operation of the hydraulic system according to the embodiment of the present invention, and FIG. 2(*b*) is a diagram describing the operation of the hydraulic system according to the embodiment of the present invention.
Figure 2B:
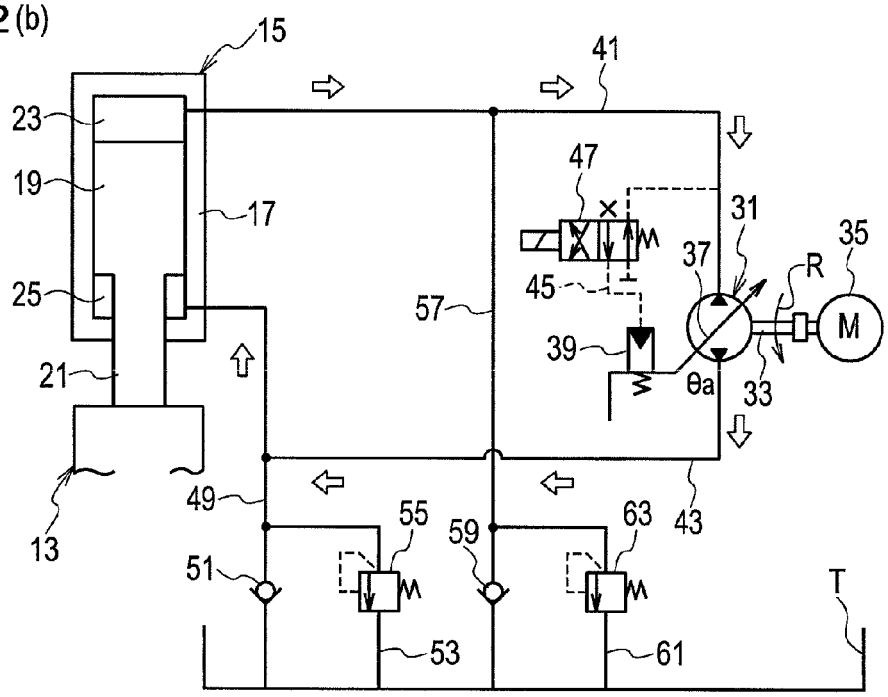
Figure 6:
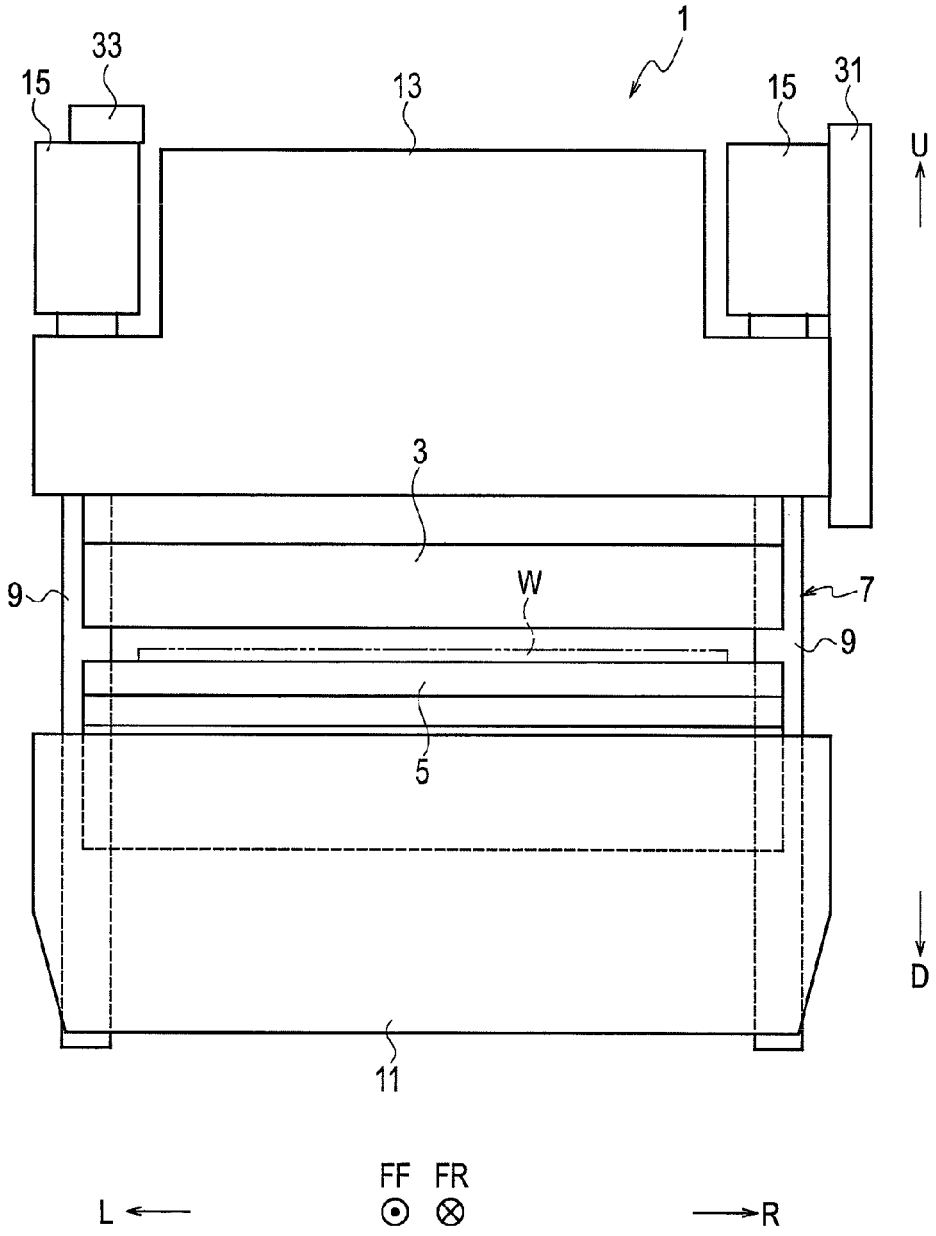
FIG. 6 is a schematic front view of the hydraulic press brake according to the embodiment of the present invention.

Note that white arrows in FIG. 1(*b*) and FIG. 2 indicate the flow of pressure oil, and "L," "R," "FF," "FR," "U," and "D" in FIG. 6 indicate leftward, rightward, frontward, rearward, upward, and downward, respectively.

As shown in FIG. 6, a hydraulic press brake 1 according to an embodiment of the present invention is configured to bend a plate-shaped workpiece W by clamping the workpiece W with a punch 3 and a die 5 and includes a body frame 7 as a base. Moreover, the body frame 7 is formed by a pair of side plates 9 separated from and facing each other in the left-right direction, a coupling member (not shown) coupling the pair of side plates 9, and the like.

A lower table 11 on which the die 5 is detachably held is provided to a lower part of the body frame 7. This lower table 11 extends in the left-right direction. Moreover, an upper table 13 on which the punch 3 is detachably held is provided to an upper part of the body frame 7 in such a way as to face the lower table 11 in the vertical direction and to be capable of being raised and lowered (moved in the vertical direction). This upper table 13 extends in the left-right direction.

As shown in FIG. 1(*a*) and FIG. 6, a lift cylinder 15 configured to raise and lower the upper table 13 is provided on each of the left and right sides of the body frame 7 (both sides of the upper table 13 in the longitudinal direction). Moreover, each lift cylinder 15 includes a tubular cylinder body 17, a piston 19 provided inside the cylinder body 17 in such a way as to be capable of being raised and lowered, and a piston rod 21 provided integrally with this piston 19 and coupled to the upper table 13. The inside of the cylinder body 17 is divided vertically into an upper hydraulic chamber 23 and a lower hydraulic chamber 25 by the piston 19.

A position detection sensor (not shown) such as a linear scale configured to detect the height position of the upper table 13 is provided at an appropriate position on the body frame 7. By monitoring the detection value from this position detection sensor, it is possible to determine that the punch 3 is positioned to an immediately-before-contact position around which the punch 3 contacts the workpiece W. In other words, the position detection sensor is configured to detect that the punch 3 is positioned to the immediately-before-contact position.

The position of this upper table 13 is programmed in advance by the operator.

Next, a hydraulic system for actuating the lift cylinders 15 will be described.

As shown in FIG. 1(*a*), a bi-directional piston pump 31 configured to select the upper hydraulic chamber 23 or the lower hydraulic chamber 25 of each lift cylinder 15 and supply pressure oil thereto is provided on an appropriate position on the body frame 7 (see FIG. 6). Moreover, the bi-directional piston pump 31 includes: a pump rotary shaft 33; a servomotor 35 as a control motor configured to rotate this pump rotary shaft 33 in a forward direction and a reverse direction; an inclined plate 37 being pivotally movable relative to this pump rotary shaft 33 and configured to vary the pump discharge volume through the pivotal movement; and a pilot chamber 39 configured to pivotally move the inclined plate 37.

Figure 3:
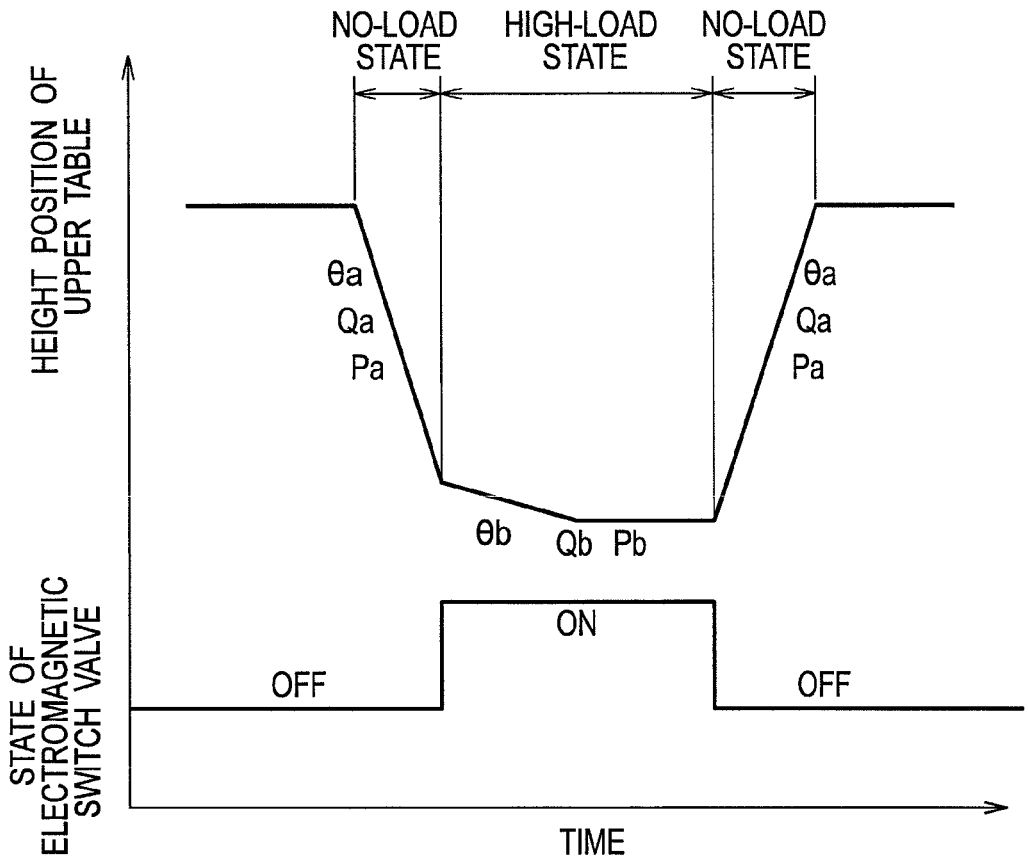
FIG. 3 is a timechart showing the height position of an upper table and the actuation state of an electromagnetic switch valve.
Figure 4:
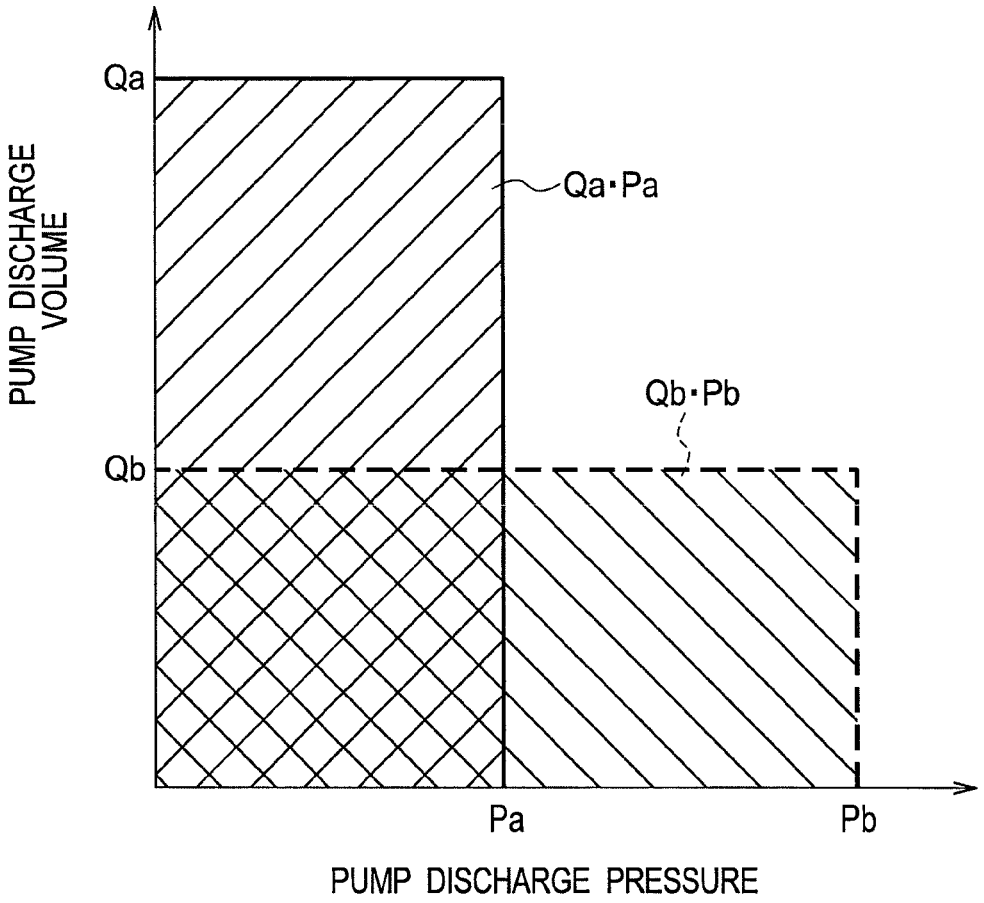
FIG. 4 is a graph showing the relationship between the pump discharge pressure and the pump discharge volume of a bi-directional piston pump according to the embodiment of the present invention.

Here, as shown in FIG. 1(*a*), FIG. 3, and FIG. 4, the pump discharge volume of the bi-directional piston pump 31 is set to a reference pump discharge volume Qa in the case where the actuation state of the lift cylinders 15 is a no-load state, and is set to a small-discharge pump discharge volume Qb smaller than the reference pump discharge volume Qa to lower the torque of the servomotor 35 of the bi-directional piston pump 31 in the case where the actuation state of the lift cylinders 15 is a high-load state.

Moreover, Qb·Pb which is the product of the pump discharge volume Qb and a pump discharge pressure Pb of the bi-directional piston pump 31 in the case where the actuation state of the lift cylinders 15 is a high-load state (a product for the bi-directional piston pump 31 in the high-load state) is set to be equal to or less than Qa·Pa which is the product of the pump discharge volume Qa and a pump discharge pressure Pa of the bi-directional piston pump 31 in the case where the actuation state of the lift cylinders 15 is a no-load state (a product for the bi-directional piston pump 31 in the no-load state) (see FIG. 4).

Note that as will be described in a later-discussed embodiment, Qb·Pb which is the product of the pump discharge volume Qb and the pump discharge pressure Pb of the bi-directional piston pump 31 in the case where the actuation state of the lift cylinders 15 is a high-load state (the product for the bi-directional piston pump 31 in the high-load state) may be set to be approximately equal to Qa·Pa which is the product of the pump discharge volume Qa and the pump discharge pressure Pa of the bi-directional piston pump 31 in the case where the actuation state of the lift cylinders 15 is a no-load state (the product for the bi-directional piston pump 31 in the no-load state).

Moreover, the bi-directional piston pump 31 is configured such that when a pilot pressure is applied to the pilot chamber 39, the inclined plate 37 pivotally moves from a reference inclination position (inclination angle position) θa corresponding to the reference pump discharge volume Qa to a small-discharge inclination position θb corresponding to the small-discharge pump discharge volume Qb. Further, the bi-directional piston pump 31 is configured such that when the pilot pressure to the pilot chamber 39 is released, the inclined plate 37 pivotally moves from the small-discharge inclination position θb back to the reference inclination position θa.

Note that when "the actuation state of the lift cylinders 15 is a no-load state" is meant to include when the lift cylinders 15 are in a light-load state. Specifically, it is from when the upper table 13 starts lowering to when the punch 3 is positioned to the immediately-before-contact position programmed in advance or contacts the workpiece W, and also is from when the upper table 13 starts rising after bending the workpiece W to when the upper table 13 is positioned to a predetermined height position programmed in advance (the original height position, for example).

Moreover, when "the actuation state of the lift cylinders 15 is a high-load state" refers to when the lift cylinders 15 are in a pressurizing state. Specifically, it is from when the punch 3 is positioned to the immediately-before-contact position programmed in advance or contacts the workpiece W to when the upper table 13 starts rising after bending the workpiece W.

As shown in FIG. 1(*a*), one end portion of a first main circuit 41 is connected to one discharge port of the bi-directional piston pump 31 while the other end portion (the other end portion side) of this first main circuit 41 is connected to the upper hydraulic chamber 23 of each lift cylinder 15. Moreover, one end portion of a second main circuit 43 is connected to the other discharge port of the bi-directional piston pump 31 while the other end portion (the other end portion side) of this second main circuit 43 is connected the lower hydraulic chamber 25 of each lift cylinder 15.

One end portion of a pilot circuit 45 is connected to the pilot chamber 39 of the bi-directional piston pump 31 while the other end portion of this pilot circuit 45 is connected to an intermediate portion of the first main circuit 41.

Moreover, an electromagnetic switch valve 47 is arranged at an intermediate portion of the pilot circuit 45. This electromagnetic switch valve 47 is configured to switch from a shutoff state to a communication state when a position detection sensor (or a pressure sensor) detects that the punch 3 is positioned to the immediately-before-contact position or contacts the workpiece W. In this way, the pilot pressure is applied to the pilot chamber 39 of the bi-directional piston pump 31.

Further, the electromagnetic switch valve 47 is configured to switch from the shutoff state to the communication state when the upper table 13 starts rising after bending the workpiece W. In this way, the pilot pressure to the pilot chamber 39 of the bi-directional piston pump 31 is released.

Note that the "shutoff state" refers to an OFF state where an inlet port and an outlet port of the electromagnetic switch valve 47 are shut off, while the "communication state" refers to an ON state where the inlet port and the outlet port of the electromagnetic switch valve 47 communicate with each other.

One end portion of a suction circuit 49 is connected to an intermediate portion of the second main circuit 43 while the other end portion of this suction circuit 49 is connected to a tank T. A check valve 51 configured to prevent the pressure oil from flowing to the tank T side is arranged at an intermediate portion of the suction circuit 49.

Moreover, one end portion of an ejection circuit 53 is connected between the check valve 51 of the suction circuit 49 and the second main circuit 43 while the other end portion of this ejection circuit 53 is connected to the tank T. A pressure control valve 55 is arranged at an intermediate portion of the ejection circuit 53.

One end portion of a suction circuit 57 is connected to an intermediate portion of the first main circuit 41 while the other end portion of this suction circuit 57 is connected to the tank T. A check valve 59 configured to prevent the pressure oil from flowing to the tank T side is arranged at an intermediate portion of the suction circuit 57.

Moreover, one end portion of an ejection circuit 61 is connected between the check valve 59 of the suction circuit 57 and the first main circuit 41 while the other end portion of this ejection circuit 61 is connected to the tank T. A pressure control valve 63 is arranged at an intermediate portion of the ejection circuit 61.

Through not shown, the speed of raising and lowering of the upper table 13 is set to a high speed in the case where the actuation state of the lift cylinders 15 is a no-load state and is set to a low speed in the case where the actuation state of the lift cylinders 15 is a high-load state, based on a publically known configuration shown, for example, in Japanese Patent Application Publication No. 2000-107814, No. 2001-121299, or No. 2004-358518.

Next, the operation and effect of the first embodiment of the present invention will be described with reference to FIG. 5 and other drawings.

Note that the hydraulic press brake is provided with a control unit (not shown) for performing overall control. This control unit is configured to control the servomotor 35, the bi-directional piston pump 31, the electromagnetic switch valve 47, and other parts based on the results of detection by the position sensor, the pressure sensor, and the like through an operation flow in FIG. 5.

Figure 5:
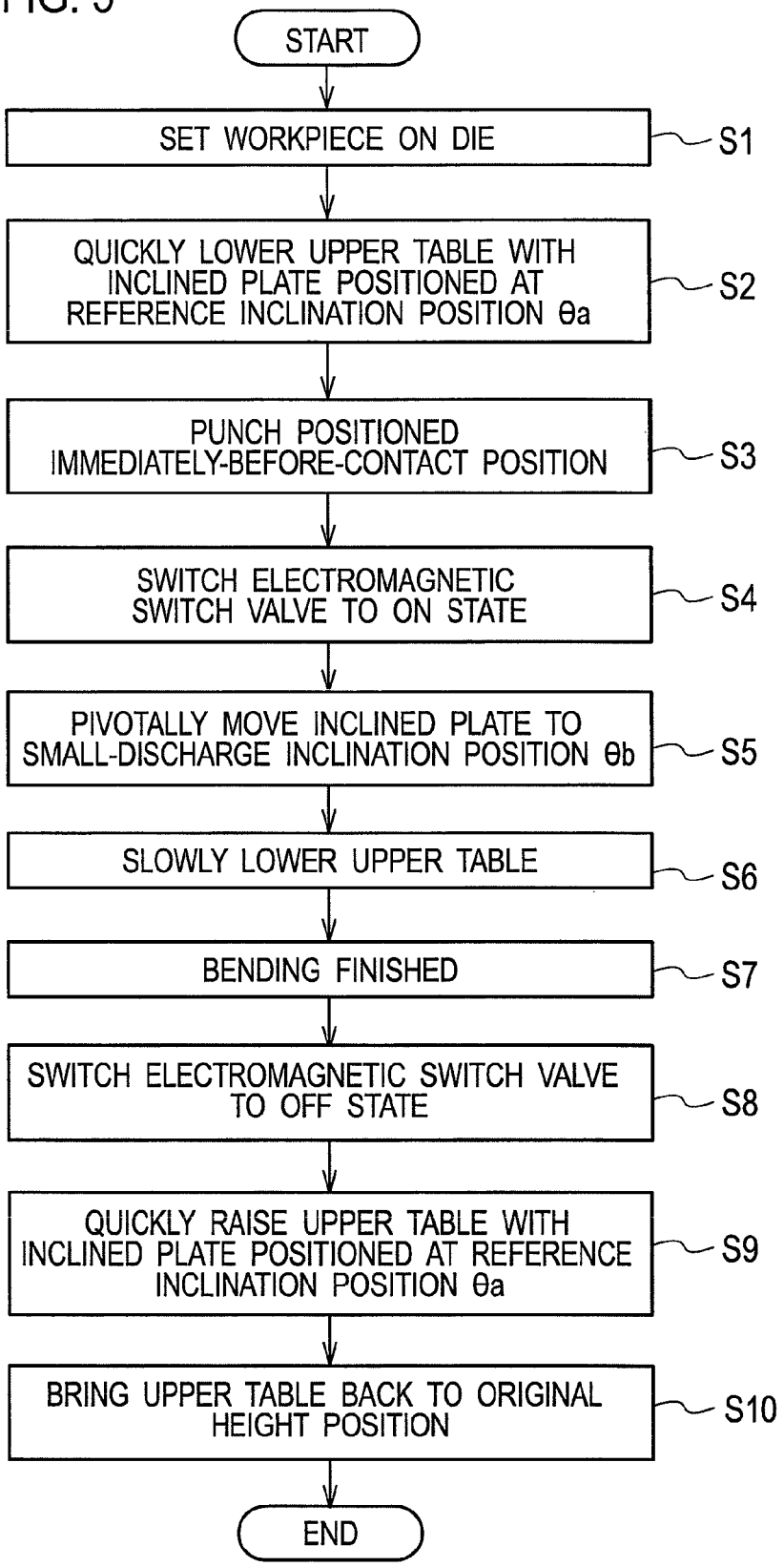
FIG. 5 is a flowchart showing the operation of a hydraulic press brake according to the embodiment of the present invention.

The workpiece W is positioned relative to the die 5 in the front-rear direction (a direction perpendicular to the longitudinal direction of the tables 11 and 13) and set on a predetermined position on the die 5 (step S1 in FIG. 5).

Then, as shown in FIG. 1(*b*) and FIG. 3, the pump rotary shaft 33 is rotated in a forward direction N by driving the servomotor 35 of the bi-directional piston pump 31 with the inclined plate 37 of the bi-directional piston pump 31 positioned at the reference inclination position θa (step S2 in FIG. 5).

As a result, the pressure oil is ejected to the second main circuit 43 from the lower hydraulic chamber 25 of each lift cylinder 15 while the pressure oil is supplied to the upper hydraulic chamber 23 of each lift cylinder 15 from the first main circuit 41. Thus, the upper table 13 can be quickly lowered to bring the punch 3 close to the workpiece W.

Then, when the position detection sensor detects that the punch. 3 is positioned to the immediately-before-contact position (step S3 in FIG. 5), the electromagnetic switch valve 47 is switched from the shutoff state (OFF state) to the communication state (ON state) as shown in FIG. 2(*a*) and FIG. 3 (step S4 in FIG. 5).

Thus, the pilot pressure is applied to the pilot chamber 39 of the bi-directional piston pump 31, so that the inclined plate 37 of the bi-directional piston pump 31 pivotally moves from the reference inclination position θa to the small-discharge inclination position θb (step S5 in FIG. 5).

As a result, the pump discharge volume of the bi-directional piston pump 31 is switched from the reference pump discharge volume Qa to the small-discharge pump discharge volume Qb, so that the upper table 13 is lowered at a low speed (step S6 in FIG. 5) and the workpiece W is bent by cooperation of the punch 3 and the die 5.

When the bending is finished (step S7 in FIG. 5), the electromagnetic switch valve 47 is switched from the communication state to the shutoff state (step S8 in FIG. 5) as shown in FIG. 2(*b*) and FIG. 3. When the pilot pressure to the pilot chamber 39 of the bi-directional piston pump 31 is released, the inclined plate 37 of the bi-directional piston pump 31 pivotally moves from the small-discharge inclination position θb back to the reference inclination position θa.

Then, the pump rotary shaft 33 is rotated in a reverse direction R by driving the servomotor 35 of the bi-directional piston pump 31 to thereby eject the pressure oil from the upper hydraulic chamber 23 of each lift cylinder 15 to the first main circuit 41 and supply the pressure oil from the second main circuit 43 to the lower hydraulic chamber 25 of each lift cylinder 15. As a result, the upper table 13 is quickly raised (step S9 in FIG. 5) to be positioned to a predetermined height position (the original height, for example) (step S10 in FIG. 5) (the operation of the hydraulic press brake 1).

According to the hydraulic press brake 1 described above, the pump discharge volume of the bi-directional piston pump 31 is variable according to the pivotal movement of the inclined plate 37 of the bi-directional piston pump 31; the pump discharge volume of the bi-directional piston pump 31 is set to the small-discharge pump discharge volume Qb smaller than the reference pump discharge volume Qa in the case where the actuation state of the lift cylinders 15 is a high-load state, and the product Qb·Pb for the bi-directional piston pump 31 in the high-load state is set to be equal to or less than the product Qa·Pa for the bi-directional piston pump 31 in a no-load state.

In this way, it is possible to sufficiently lower the torque of the servomotor 35 of the bi-directional piston pump 31 in the case where the actuation state of the lift cylinders 15 is a high-load state (unique effect of the hydraulic press brake 1).

Thus, according to the first embodiment of the present invention, it is possible to achieve power saving through reduction of the power consumption of the servomotor 35 of the bi-directional piston pump 31, and also to reduce the manufacturing cost of the hydraulic press brake 1 through reduction of the motor capacity of the servomotor 35 of the bi-directional piston pump 31.

(Second Embodiment)

A second embodiment of the present invention will be described with reference to FIG. 7.

Figure 7:
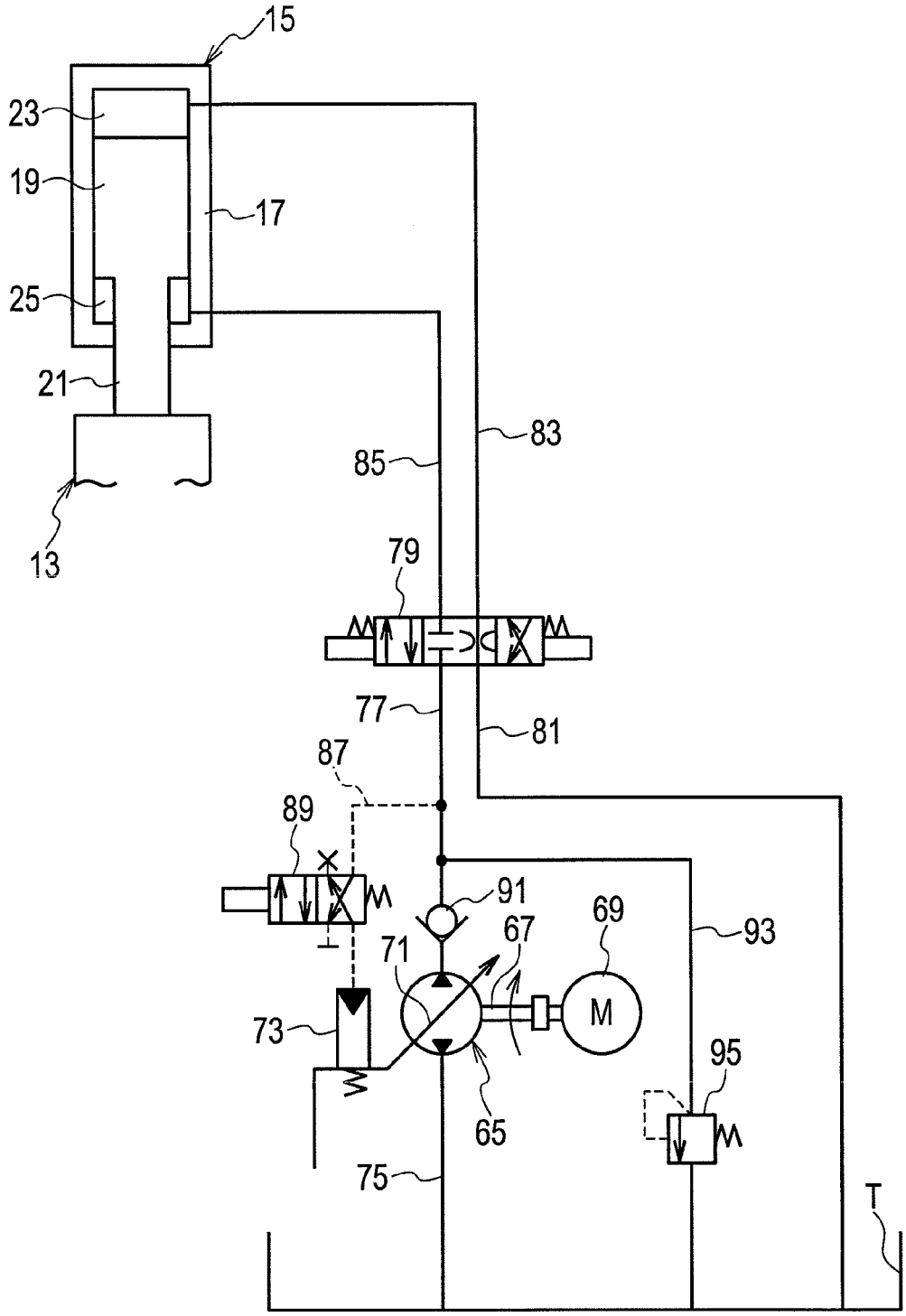
FIG. 7 is a diagram showing a hydraulic system according to another embodiment of the present invention.

In the second embodiment of the present invention, a hydraulic system shown in FIG. 7 is used instead of the hydraulic system shown in FIG. 1(*a*), and the configuration of the hydraulic system according to the second embodiment of the present invention is as follows.

A uni-directional piston pump 65 configured to supply pressure oil to an upper hydraulic chamber 23 and a lower hydraulic chamber 25 of each lift cylinder 15 is provided at an appropriate position on a body frame. Moreover, the uni-directional piston pump 65 includes a pump rotary shaft 67, an induction motor 69 as a rotary motor configured to rotate this pump rotary shaft 67, an inclined plate 71 pivotally movable relative to this pump rotary shaft 67 and configured to vary the pump discharge volume through the pivotal movement; and a pilot chamber 73 configured to pivotally move the inclined plate 71.

Here, like the pump discharge volume of the bi-directional piston pump 31 of the first embodiment, the pump discharge volume of the uni-directional piston pump 65 is set to a reference pump discharge volume Qa in the case where the actuation state of the lift cylinders 15 is a no-load state. Moreover, the pump discharge volume is set to a small-discharge pump discharge volume Qb smaller than the reference pump discharge volume Qa to lower the torque of the induction motor 69 of the uni-directional piston pump 65 in the case where the actuation state of the lift cylinders 15 is a high-load state.

Moreover, Qb·Pb which is the product of the pump discharge volume Qb and a pump discharge pressure Pb of the uni-directional piston pump 65 in the case where the actuation state of the lift cylinders 15 is a high-load state (a product for the uni-directional piston pump 65 in the high-load state) is set to be equal to or less than Qa·Pa which is the product of the pump discharge volume Qa and a pump discharge pressure Pa of the uni-directional piston pump 65 in the case where the actuation state of the lift cylinders 15 is a no-load state (a product for the uni-directional piston pump 65 in the no-load state) (see FIG. 4).

Moreover, the uni-directional piston pump 65 is configured such that the inclined plate 71 pivotally moves from a reference inclination position θa to a small-discharge inclination position θb when a pilot pressure is applied to the pilot chamber 73. Further, the uni-directional piston pump 65 is configured such that the inclined plate 71 pivotally moves from the small-discharge inclination position θb back to the reference inclination position ea when the pilot pressure to the pilot chamber 73 is released.

One end portion of a suction circuit 75 is connected to a suction port of the uni-directional piston pump 65 while the other end portion of this suction circuit 75 is connected to a tank T. Moreover, one end portion of a discharge circuit 77 is connected to a discharge port of the uni-directional piston pump 65 while the other end portion of this discharge circuit 77 is connected to one inlet port of an electromagnetic direction control valve 79.

The electromagnetic direction control valve 79 is switchable among a neutral position, a lowering switch position at which one inlet port and one outlet port communicate with each other and the other inlet port and the outer outlet port communicate with each other, and a raising switch position at which the one inlet port and the other outlet port communicate with each other and the other inlet port and the one outlet port communicate with each other.

Here, the upper table 13 is lowered by switching the electromagnetic direction control valve 79 from the neutral position to the lowering switch position with the uni-directional piston pump 65 running. The upper table 13 is raised by switching the electromagnetic direction control valve 79 from the neutral position to the raising switch position with the uni-directional piston pump 65 running.

One end portion of an ejection circuit 81 is connected to the other inlet port of the electromagnetic direction control valve 79 while the other end portion of this ejection circuit 81 is connected to the tank T. Moreover, one end portion of a first main circuit 83 is connected to the one outlet port of the electromagnetic direction control valve 79 while the other end portion (the other end portion side) of this first main circuit 83 is connected to the upper hydraulic chamber 23 of each lift cylinder 15. Further, one end portion of a second main circuit 85 is connected to the other outlet port of the electromagnetic direction control valve 79 while the other end portion (the other end portion side) of this second main circuit 85 is connected to the lower hydraulic chamber 25 of each lift cylinder 15.

One end portion of a pilot circuit 87 is connected to the pilot chamber 73 of the uni-directional piston pump 65 while the other end portion of this pilot circuit 87 is connected to an intermediate portion of the discharge circuit 77. Moreover, an electromagnetic switch valve 89 is arranged at an intermediate portion of the pilot circuit 87, and this electromagnetic switch valve 89 has a configuration similar to that of the electromagnetic switch valve 47.

A check valve 91 configured to prevent the pressure oil from flowing to the uni-directional piston pump 65 side is arranged between the uni-directional piston pump 65 at an intermediate portion of the discharge circuit 77 and the other end portion of the pilot circuit 87. Moreover, one end portion of an ejection circuit 93 is connected between the check valve 91 at an intermediate portion of the discharge circuit 77 and the other end portion of the pilot circuit 87, while the other end portion of this ejection circuit 93 is connected to the tank T. A pressure control vale 95 is arranged at an intermediate portion of the ejection circuit 93.

An operation and effect similar to those of the first embodiment described above can be achieved even in the case of using this hydraulic system according to the second embodiment of the present invention.

(Third Embodiment)

A third embodiment of the present invention is the first or second embodiment described above in which Qb·Pb that is the product of the pump discharge volume Qb and the pump discharge pressure Pb of the bi-directional piston pump 31 in the case where the actuation state of the lift cylinders 15 is a high-load state (the product for the bi-directional piston pump 31 in the high-load state) is set to be approximately equal to Qa·Pa that is the product of the pump discharge volume Qa and the pump discharge pressure Pa of the bi-directional piston pump 31 in the case where the actuation state of the lift cylinders 15 is a no-load state (the product for the bi-directional piston pump 31 in the no-load state). The other features of the configuration and the effect are similar to those of the first or second embodiment described above and will therefore not be described.

Note that the present invention is not limited to the embodiments described above and can be carried out in various ways as below. Specifically, instead of raising and lowering the upper table 13 with the lift cylinders 15, the lower table 11 may be raised and lowered with other lift cylinders (not shown). Moreover, instead of making the pump discharge volume of the bi-directional piston pump 31 (uni-directional piston pump 65) variable in two levels with the reference pump discharge volume Qa and the small-discharge pump discharge volume Qb, the pump discharge volume may be made variable in three or more levels or continuously variable.

Further, the configuration may be such that the pump discharge volume of the bi-directional piston pump 31 (uni-directional piston pump 65) in the case where the actuation state of the lift cylinders 15 is a no-load state can be selected from one of the reference pump discharge volume Qa and the small-discharge pump discharge volume Qb.

Figure 8:
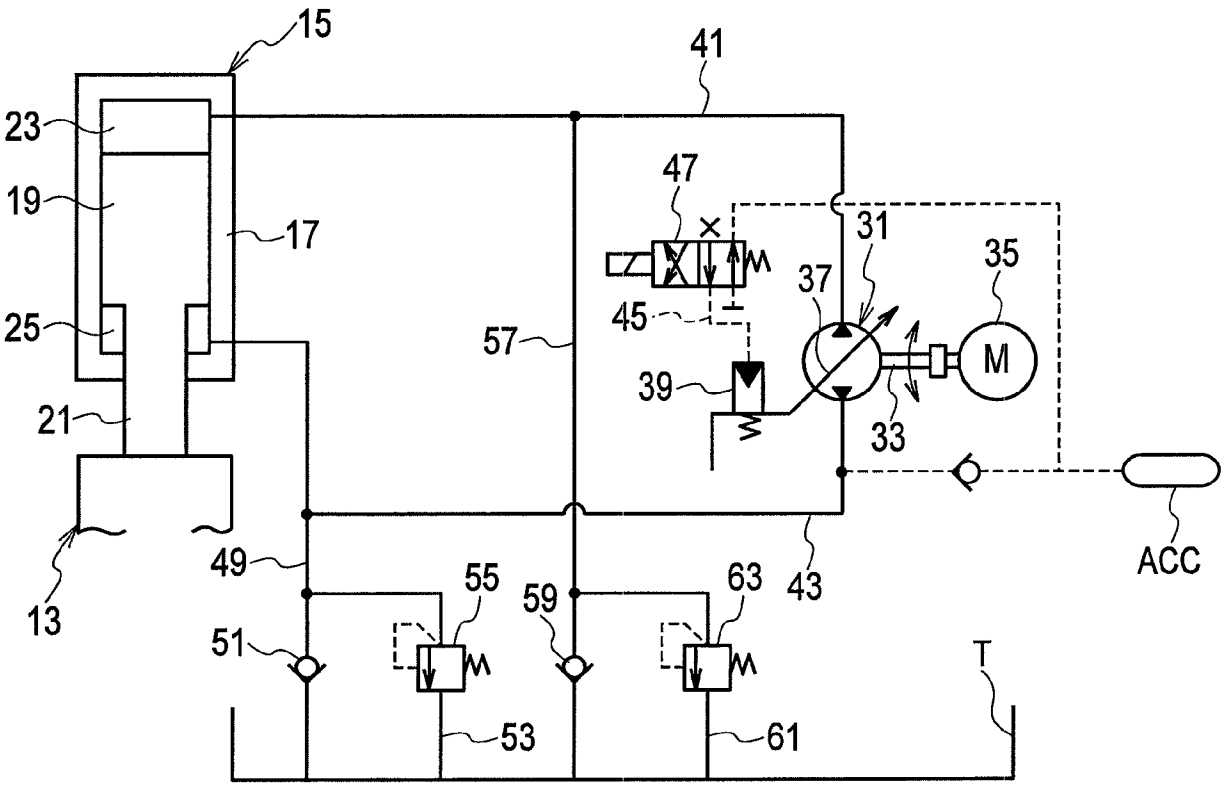
FIG. 8 is a diagram showing a hydraulic system according a modification of the embodiment shown in FIG. 1.

Furthermore, as shown in FIG. 8, as a modification of the first embodiment shown in FIG. 1, a line including a combination of a check valve and an accumulator ACC may be provided to the second main circuit 43 and a line configured to supply the pilot pressure to the electromagnetic switch valve 47 from the accumulator ACC may be provided so that pressure can be accumulated in the accumulator ACC when the upper table 13 is raised.

In addition, the scope of right encompassed by the present invention is not limited to these embodiments.

INDUSTRIAL APPLICABILITY

According to the present invention, it is possible to lower the torque of the above-mentioned rotary motor in the case where the actuation state of the above-mentioned lift cylinders is a high-load state. Thus, it is possible to achieve energy saving through reduction of the power consumption of the rotary motor of the above-mentioned piston pump.

The invention claimed is:

1. A hydraulic press brake configured to bend a plate-shaped workpiece by clamping the workpiece with a punch and a die, comprising:

a lower table which is provided to a lower part of a body frame and on which the die is detachably held;

an upper table which is provided to an upper part of the body frame in such a way as to face the lower table in a vertical direction and is capable of being raised and lowered relative to the lower table, and on which the punch is detachably held;

a lift cylinder including a tubular cylinder body and a piston provided inside the cylinder body in such a way as to divide an inside of the cylinder body into a pair of hydraulic chambers and to be capable of being raised and lowered relative to the cylinder body, the lift cylinder including the cylinder body and the piston to raise and lower the upper table relative to the lower table;

a piston pump including a pump rotary shaft, a rotary motor configured to rotate the pump rotary shaft, and an inclined plate being pivotally movable relative to the pump rotary shaft and configured to vary a pump discharge volume of the piston pump through the pivotal movement, the piston pump being configured to supply pressure oil to the hydraulic chambers of the lift cylinder, wherein the pump discharge volume of the piston pump is set to a reference pump discharge volume in a case where an actuation state of the lift cylinder is a no-load state, and is set to a small-discharge pump discharge volume smaller than the reference pump discharge volume to lower a torque of the rotary motor of the piston pump in a case where the actuation state of the lift cylinder is a high-load state, the piston pump including a pilot chamber configured to pivotally move the inclined plate, and is configured such that the inclined plate pivotally moves from a reference inclination position corresponding to the reference pump discharge volume to a small-discharge inclination position corresponding to the small-discharge pump discharge volume when a pilot pressure is applied to the pilot chamber; and a sensor configured to detect that the punch is positioned at an immediately-before-contact position that is proximate a contact surface of the workpiece or a contact position in which the punch contacts the contact surface of the workpiece, and the pilot pressure is applied to the pilot chamber when the sensor detects that the punch is positioned to the immediately-before-contact position or contacts the workpiece.

2. The hydraulic press brake according to claim 1, wherein a product of the pump discharge volume and a pump discharge pressure of the piston pump in the case where the actuation state of the lift cylinder is the high-load state is set to be equal to or less than a product of the pump discharge volume and a pump discharge pressure of the piston pump in the case where the actuation state of the lift cylinder is the no-load state.

3. The hydraulic press brake according to claim 1, wherein the piston pump is a bi-directional piston pump, and the rotary motor is a control motor capable of rotating in a forward direction and a reverse direction.

4. The hydraulic press brake according claim 1, wherein the piston pump is a uni-directional piston pump.

5. The hydraulic press brake according to claim 1, wherein a product of the pump discharge volume and a pump discharge pressure of the piston pump in the case where the actuation state of the lift cylinder is the high-load state is set to be approximately equal to a product of the pump discharge volume and a pump discharge pressure of the piston pump in the case where the actuation state of the lift cylinder is the no-load state.

* * * * *